United States Patent [19]

Horgen

[11] Patent Number: 4,784,390

[45] Date of Patent: Nov. 15, 1988

[54] METHOD OF PLAYING A MATCHED SET OF GOLD CLUBS

[75] Inventor: Floyd D. Horgen, Rockledge, Fla.

[73] Assignee: James Schacht, Clarksville, Tenn. ; a part interest

[21] Appl. No.: 38,774

[22] Filed: Apr. 15, 1987

[51] Int. Cl.[4] ..... A63B 53/00

[52] U.S. Cl. ..... 273/77 A; 434/252; 273/187 R; 273/32 H

[58] Field of Search ..... 273/77 R, 77 A, 32 H, 273/32 R, 187 R; 434/252

[56] References Cited

U.S. PATENT DOCUMENTS

| | | | |
|---|---|---|---|
| 1,516,786 | 11/1924 | Prentiss | 273/77 A |
| 1,594,801 | 8/1926 | Stackpole | 273/77 A |
| 3,109,244 | 11/1963 | Trifaro et al. | 434/252 |
| 3,984,103 | 10/1976 | Nix | 273/77 A |
| 4,674,324 | 6/1987 | Benoit | 273/77 A |
| 4,679,791 | 7/1987 | Hull | 273/77 A |

OTHER PUBLICATIONS

"Golf Digest", Dec. 1967, pp. 20-21, One-Swing Iron.
"Golf Digest", Oct. 1968, p. 16, Now One-Swing Woods.
"Golf Digest", Dec. 1976, pp. 60-64, Dynamic New Ways to Match Clubs So They Feel The Same.

*Primary Examiner*—George J. Marlo
*Attorney, Agent, or Firm*—Kinney & Lange

[57] ABSTRACT

A method of playing a set of golf clubs in which all of the woods and/or irons are of equal length, the same lie, the same weight permit the golfer to have one swing for all woods in a set and one swing for all irons, regardless of the loft of the club. In addressing the golf ball with each club of the set, the player's arms are outstretched and pointed at the ball, and that relationship between the player's arms and the club shaft is the same at ball impact.

2 Claims, 4 Drawing Sheets

METHOD OF PLAYING A MATCHED SET OF GOLD CLUBS

BACKGROUND OF THE INVENTION

1. Field of the Invention.

The present invention relates to golf, and in particular to a set of golf clubs in which all of the woods and/or all of the irons are of equal length, weight, swing weight, and lie.

2. Description of the Prior Art.

The game of golf is one of the most popular participant sports in the world. It is played by persons by all ages, both men and women. For the majority of golfers, the game is a source not only of joy and excitment, but also of frustation. It may be said that golf is a very difficult game played with implements ill-designed for the purpose.

Traditionally, golf is played with a set of clubs of varying length, weight, lie and loft. The length of the club increases with decreasing loft, so that the wedge has the greatest loft and the driver has the least loft. At the same time, the weight of the clubs decreases with increasing length so that the swing weight of the clubs is the same.

In a normal traditional set of golf clubs, each club is designed so that when the player swings the club back and then down, his or her arms come back down so that they are perpendicular to the ground and the club goes out and hits the ball. There is a slight angle between the player's arms and the shaft of the club. It does not matter whether the golfer has a 9-iron, a 5-iron, a 2-iron, or a driver. The only thing that the player does is move farther away from the golf ball as the length of the club becomes longer. The further the player is from the ball, the smaller the angle between the player's arms and the shaft of the club. The traditional clubs are designed so that the lie (the angle between the shaft and the club head) becomes larger as the club is longer.

There are basically three things that the golfer must be ablet to do to hit the golf ball properly. First, the player has to be able to swing his arms all the way around in a circle. This will cause the club head to also travel in another, different circle.

Second, the player must be able to support the swing of his arms with his legs. In the back swing, the right leg supports the swing, and in the down swing the right leg continues to support the swing. In the follow-through, the left leg supports the swing.

Third, the golfer must be able to aim the swing so that the ball travels toward the target. This proves to be a problem for many players. There is a tendency to aim to the right and pull the ball back to the target.

With a normal set of golf clubs, a proper swing requires that the shoulders move in one plane, the arms move in a second plane, and the shaft move in a third plane. This proves to be very difficult for the vast majority of golfers. Only about one or two percent of the players in the world (representing the touring professionals and the very best amateurs) are actually able to swing properly and have a single swing for all of the clubs in a set. Instead, the amateur golfer typically has more difficulty using certain clubs than others. Most typically, the clubs with lesser loft (especially the long irons) are the most difficult for the amateur to use.

SUMMARY OF THE INVENTION

The present invention is based upon my observation, from studying photographs and video tapes of numerous golfers, that the natural tendency of most golfers is to swing their arms at the ball so that, on the down-swing, the angle between the arms and the club shaft becomes close to 180°. In other words, on the down-swing the arms are not returned to their initial position in which they are extending straight down toward the ground.

By swinging the arms directly at the ball, the golfer's weight is forced forward too soon, which leaves the club face open, and also contributes to hitting a slice. With the traditional golf clubs used in the past only a very small percentage of players are actually able to swing all of the clubs properly. Instead, as the club gets longer and the player starts out further and further away from the ball, the tendency to swing the arms directly at the ball on the down-swing results in different adjustments in order to hit each club, and therefore the player will have thirteen different swings. With each club, the player will have to find some way to bring the club head back into contact with the ball because the arms being totally outstretched forces the club head outside of the ball (particularly with the longer clubs).

With the present invention, all of the woods and/or all of the irons in the set have the same length, the same overall weight, and the same swing weight. The only difference between the woods is their loft and the only difference between the irons is their loft.

The lie of the clubs is selected so that the player can extend his arms with the front arm in a straight line with the club shaft pointing directly at the ball at the time of address. As the player reaches the top of his swing and starts the down-swing, he is able to do so what feels natural: he is going to swing at the ball with his arms outstretched and pointing directly at the ball and the shaft of the club aligned with the left arm.

Regardless of the wood/iron that is selected, the swing is exactly the same. Because there are no differences in club length, and the ball is to be hit with the arms aligned with the club shaft, the player will not have a tendency to bring the club head to the outside of the ball and then compensate to bring it back into the ball. Instead, the player will keep the club head inside of the ball throughout the swing, which allows the golfer to stay behind the golf ball and to leave the club head back (i.e. not prematurely shift weight from the right leg to the left leg in the case of a right-handed golfer).

The present invention permits the amateur golfer to truly have one swing (or two swings—one for woods and one for irons) rather than thirteen different swings. For the vast majority of golfers, this offers the opportunity for more consistent play because a player can hit essentially all of the clubs, rather than a few of the clubs, with consistency.

DETAILED DESCRIPTION OF THE PREFERRED EMBODIMENTS

Figure 1:
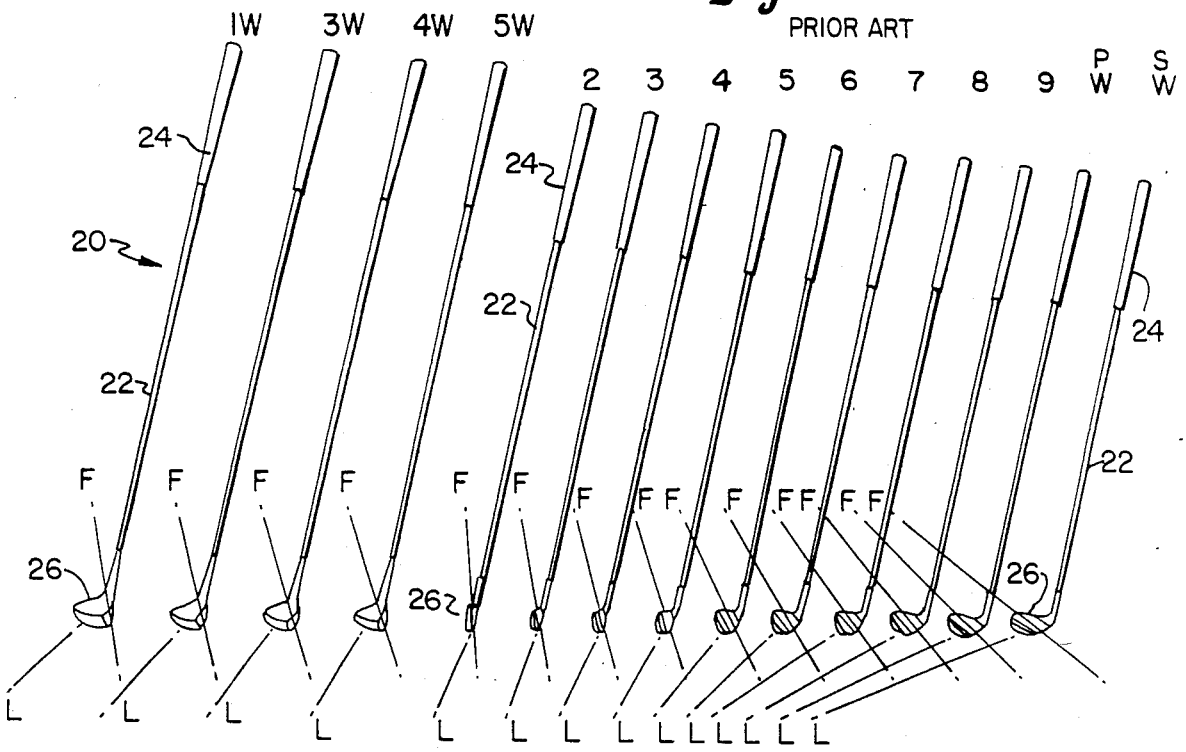
Fig. 1 PRIOR ART
FIG. 1 shows a prior art set of golf clubs having woods and irons of differing lengths as a function of loft.

FIG. 1 shows a conventional set of golf clubs 20 which includes the 1, 3, 4 and 5 woods, the 2–9 irons, the pitching wedge (PW) and the sand wedge (SW). Because of the limit of fourteen clubs in tournament play, most sets will include a putter in addition to thirteen of the clubs shown in FIG. 1.

As shown in FIG. 1, each wood and iron has a shaft 22 with a grip 24 at its upper end and a club head 26 at its lower end. The length of the shafts 22 (and therefore the overall length) of the clubs in the set is different for each club. The sand wedge SW is the shortest, and the driver (1-wood) is the longest. In other words, the length of the club increases with decreasing loft. Loft is defined as the angle between the club face and vertical. The orientation of each club face is shown in FIG. 1 with the line designated "F".

The lie of the clubs of set 20 also changes with increasing length. Lie is the angle between the club shaft 22 and the bottom or sole of the club. The position of the club sole is shown in each case with line designated "L". The angle defining the lie is smallest for the sand wedge and largest for the driver.

The clubs of set 20 also differ in weight. The sand wedge SW is the heaviest club, while the driver 1W is the lightest. This difference in weight compensates for the differing club length, so that the swing weight of all of the clubs of set 20 are essentially the same.

Figure 2:
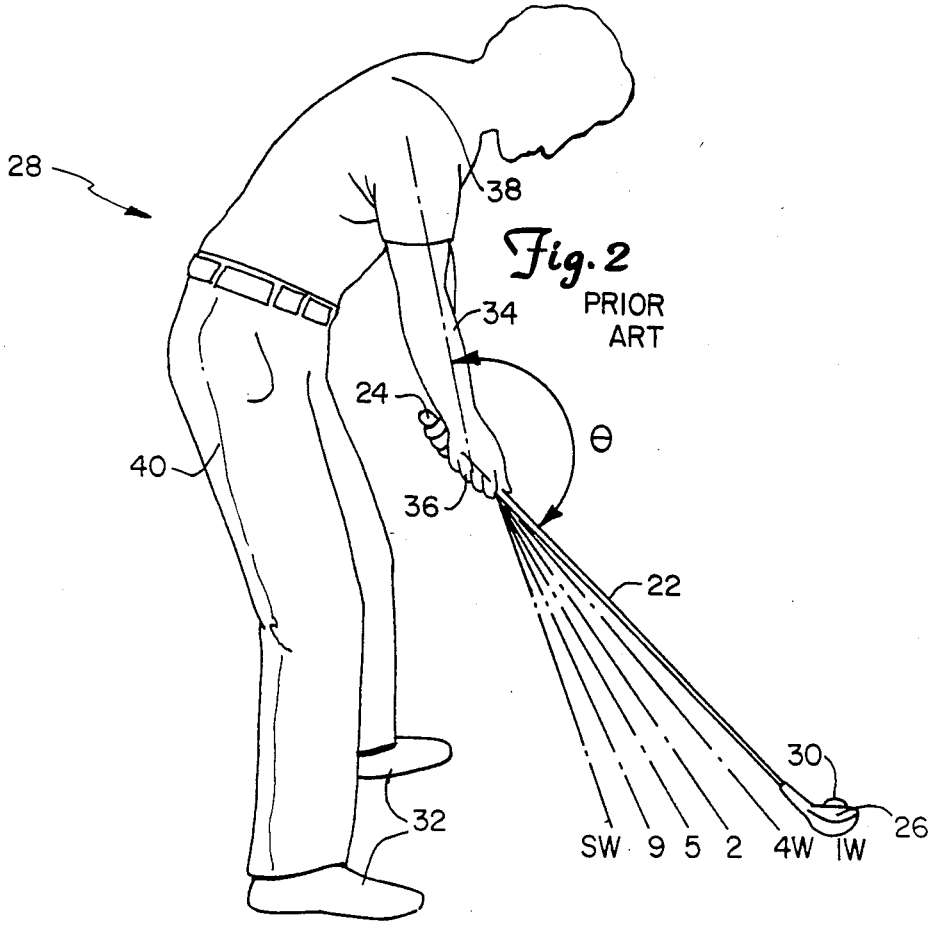
Fig. 2 PRIOR ART
FIG. 2 is a view from behind a golfer showing the differing distance from the ball and differing angle of the club shaft and arms resulting from the different lengths of clubs in the prior art set shown in FIG. 1.

As shown in FIG. 2, the longer the club, the further golfer 28 places his feet away from ball 30. As shown in solid lines in FIG. 2, the golfer is holding a driver. The arms of the golfer are extending generally vertically, and an angle is formed between the arms and the club shaft S.

FIG. 2 also illustrates the position of the clubs and the ball for the 4-wood, the 2-iron, the 5-iron, the 9-iron, and the sand wedge. As the length of the club decreases, the distance between ball 30 from the golfer's feet 32 decreases. As a result, the angle $\theta$ increases so that arms 34 are more nearly aligned with the club shaft 22 when using the sand wedge than with longer irons and the woods.

Figure 3:
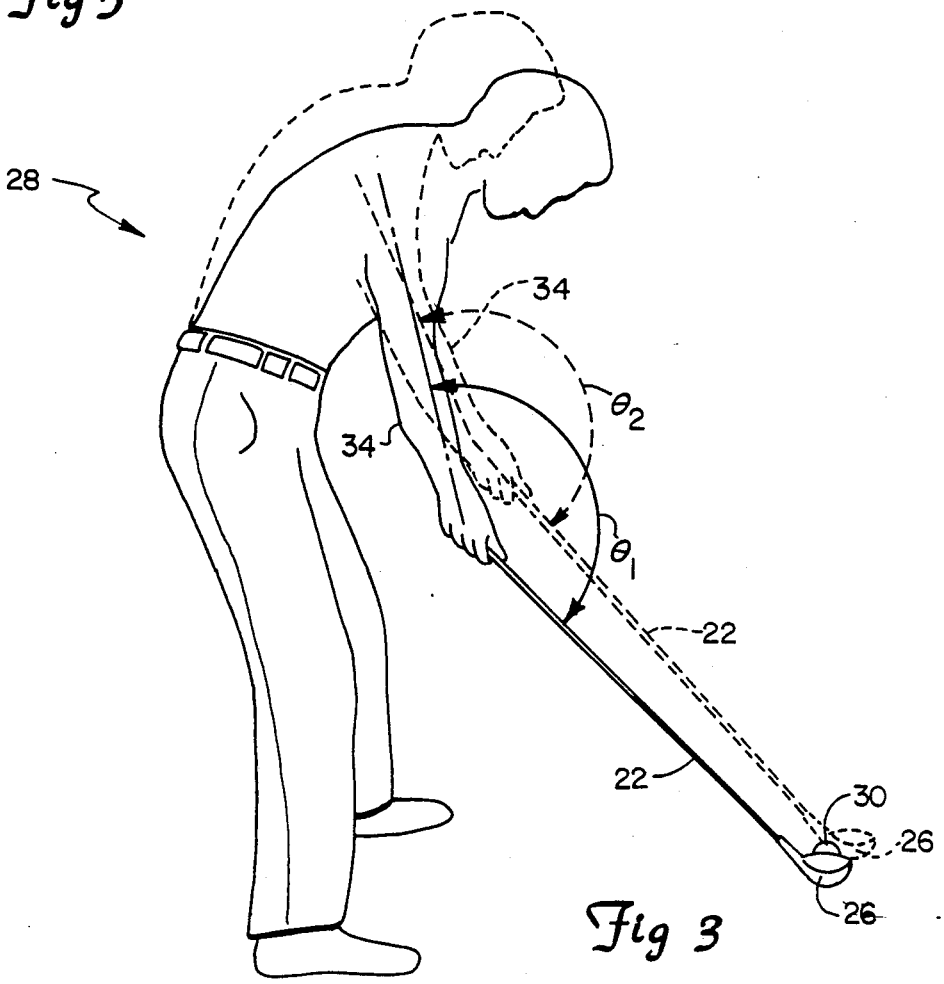
FIG. 3 is a drawing showing the initial address position and the resulting swing outside of the ball which occurs when the player swings his hand at the ball during the down-swing.

To hit the ball properly with a conventional set of clubs 20, golfer 28 must return hands 36 to the same position that they were in at the address when contact is made with ball 30. It is my observation, however, that the natural tendency is not to return hands 36 and arms 34 to a position where arms 34 extend essentially downward and perpendicular to the ground. Instead, during the down-swing the golfer 28 has a tendency to point the front arm and hand (i.e. left arm and hand for a right-handed golfer) directly at ball 30. In other words, the angle $\theta$ becomes essentially 180°. This is not much of a problem with the short irons—as can be seen in FIG. 2 the angle $\theta$ is nearly 180° for the sand wedge. With the longer irons and the woods, however, the angle is substantially less than 180°. When the golfer 28 points the arms 34 directly at the ball 30 during the down-swing, the angle changes from $\theta$ to $\theta_2$ as illustrated in FIG. 3, which effectively lengthens the combined length of arms 34 and the club. As a result, the club head 26 is forced to the outside of the ball 30, as illustrated in phantom in FIG. 3. In order to compensate for the effective increase in the length of the club, the golfer will tend to correct by pulling the front shoulder out prematurely, by rushing the club head 26, or by prematurely shifting weight.

The result is that the golfer has a custom swing for each club (or thirteen different swings). Because the compensation needed to correct for improper arm extension during the down-swing is more severe for the longer clubs (those with lesser loft), it is typical for golfers to have more success with the short iron than with the longer irons. Typically, the longest iron in a player's bag (the 2 or 3-iron) will be the cleanest and least-used club in the bag because the player simply cannot use it effectively.

Figure 5:
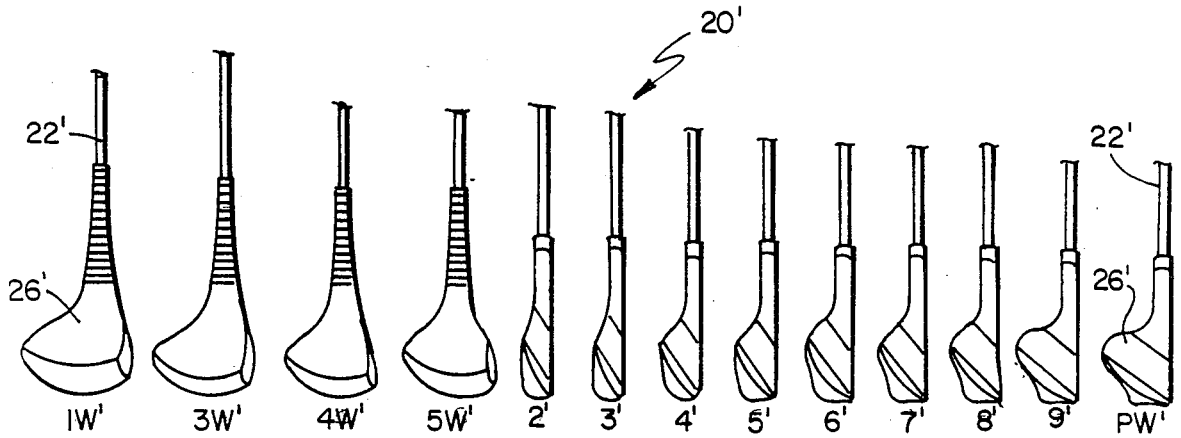
FIGS. 4 and 5 show a set of golf clubs in accordance with the present invention.
Figure 4:
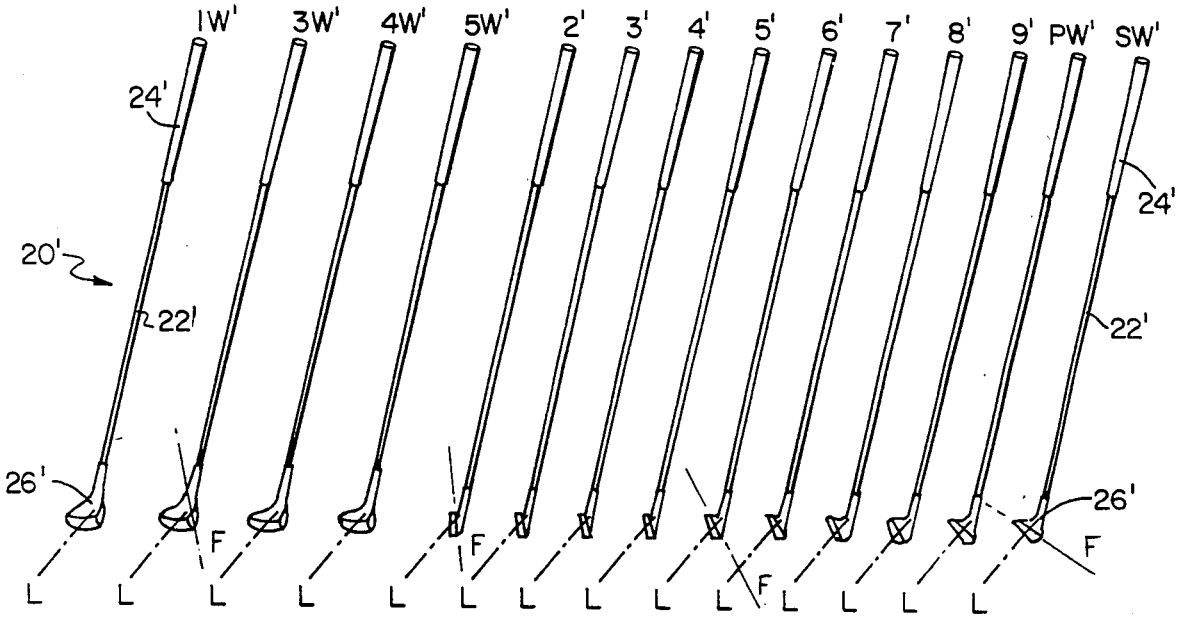
Figure 6:
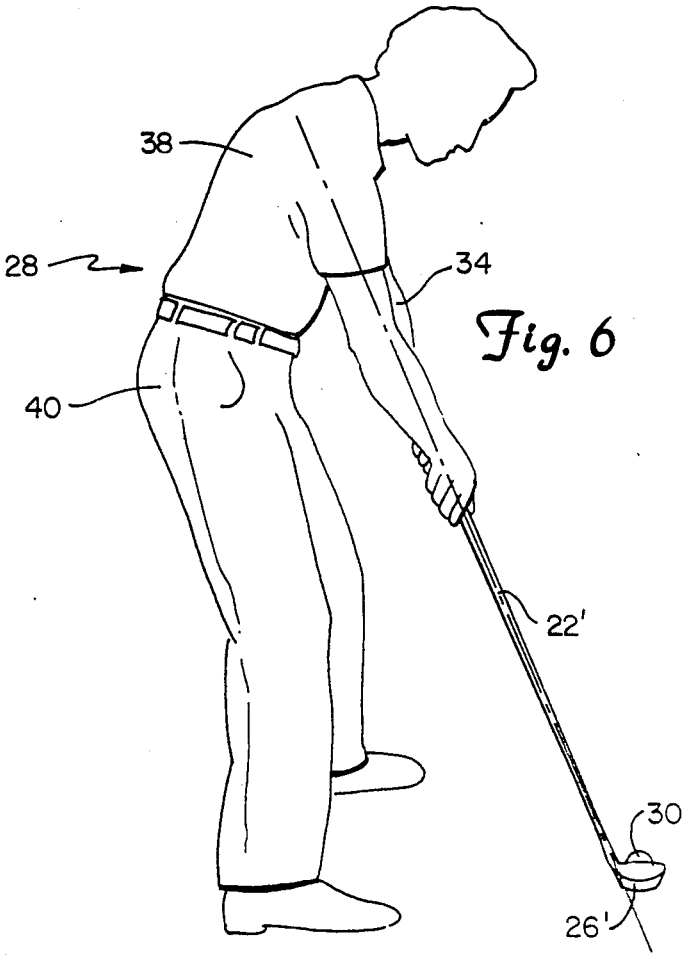
FIG. 6 shows a golfer addressing the ball using one of the clbs of the set shown in FIGS. 4 and 5.

FIGS. 4 and 5 show a set 20′ of golf clubs made in accordance with one embodiment of the present invention. For reference, similar clubs and parts are designated with the same reference characters as in FIGS. 1–3, except with the addition of a prime (′). In the present invention, all of the irons and woods have the same length, the same overall weight, the same swing weight, and the same lie. The only difference between the clubs is the loft.

With the present invention, golfer 28 can align arms 34 with the club shaft 22′ and swing every club the same—with the arms 34 pointing directly at the ball. The result is a single swing which can be used with all of the woods and irons.

Because the arms 34 are aligned with the club shaft 22′, the present invention simplifies the swing. Shoulders 38, arms 34 and shaft 22′ are all moving in a common plane, while hips 40 rotate in a second plane. This is in contrast to the swing required by a traditional set of clubs 20, in which the shoulders 38 move in one plane, the arms 34 move in a second plane, and shaft 22 moves in a third plane.

In a preferred embodiment of the present invention, all of the woods and irons of the set have the lie of a traditional 7-iron (about 61° to about 62°) and the shaft length of a traditional 6-iron (about 37 inches for an average height golfer). The shaft length will vary, of course, depending upon the height of the golfer.

Although shaft 22′ may be made of any suitable material, tests have indicated the graphite shafts are particularly advantageous. It appears that the graphite shafts provide a greater flexibility, which is particularly useful with the clubs having lesser loft (i.e. the long irons and the woods).

Figure 7:
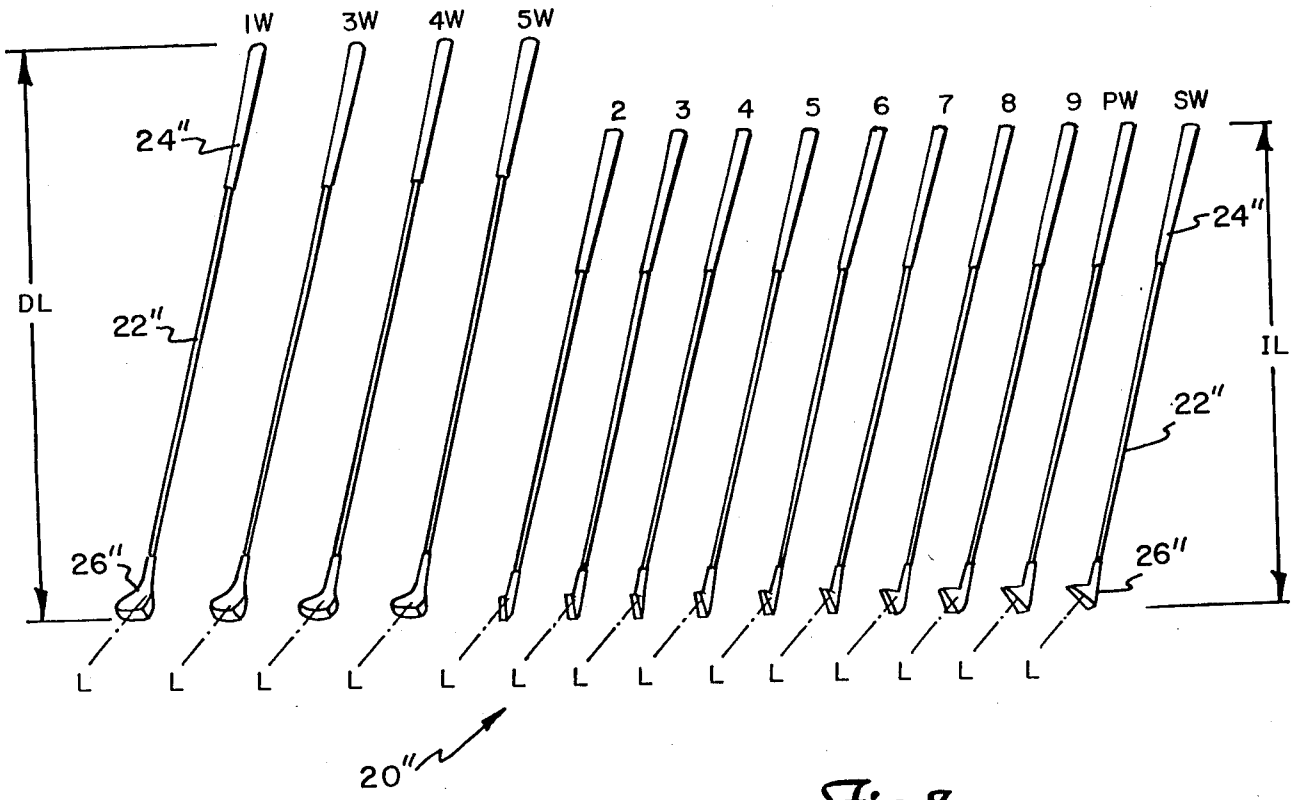
FIG. 7 shows another embodiment of the present invention in which all woods are of equal length and all irons are of equal length.

FIG. 7 shows another embodiment of the present invention in which a set 20″ of golf clubs has woods that are all of the same length, the same overall weight, the same swing weight, and the same lie. Similarly, all of the irons are of the same length, the same overall weight, the same swing weight, and the same lie. The only difference among the woods is their loft, and similarly, the only difference among the irons is their loft.

In the embodiment shown in FIG. 7, the length of the woods is somewhat longer than that of the irons. For example, for a golfer of average height, the irons are preferably about thirty-seven inches long, while the woods are about forty-one inches long. This corresponds to a shaft length of a traditional 6-iron for the irons and a shaft length corresponding to a short 5-wood for the woods. Because the lengths are somewhat different, the lies of the irons and woods will also differ. In a preferred embodiment, the lie of the irons is about 61° to about 62°, and the lie of the woods is about 58°. In other words, the woods lie a little flatter than the irons because of the somewhat longer shaft length.

The reason for using slightly longer shaft lengths for the woods is to increase distance. The need for lengthening the woods with respect to the irons depends upon the particular shaft material being used.

With the embodiment shown in FIG. 7, the golfer need only have two different swings, one for all the irons, and one for all the woods. In both cases, the golfer will be permitted to extend the arms and hands directly at the ball during the down swing. This the set 20'' shown in FIG. 7 also greatly simplifies the task to be performed by the golfer. For the vast majority of amateur golfers, it means the difference between having only two swings versus having thirteen different swings.

In conclusion, the present invention provides a set of clubs which is better suited to the vast majority of amateur golfers. It makes the golf swing more natural by recognizing the natural tendencies of the golfer to throw the hands and arms directly at the ball during the down-swing. With the present invention, the golfer can practice a single swing which is usable with all of the clubs because all of the clubs have the same length, the same weight and the same lie.

Although the present invention has been described with reference to preferred embodiments, workers skilled in the art will recognize that changes may be made in form and detail without departing from the spirit and scope of the invention.

What is claimed:

1. A method for conditioning a golf player to focus his attention on the position of his hands and arms relative to a golf ball while swinging a golf club at that ball rather than focusing his attention on the position of the golf club head relative to the ball and to thereby use substantially the same swing for striking the golf ball with every golf club in a set of plurality of matched golf clubs wherein each club of the set has essentially the same length, essentially the same weight, essentially the same swing weight and essentially the same lie but the golf clubs differ from one another in loft, the method comprising the step of:

a. the player assuming substantially the same stance in posture and distance relative to the golf ball for use of each golf club in the set;

b. the player pointing his arms directly at the ball at the time of address for use of each golf club in the set; and c. the player swinging the golf club to strike the golf ball so that the player's arms are again pointing directly at the ball at the point of impact for each golf club in the set, with the angle defined between the player's arms and the golf club shaft being substantially the same at address and impact, thereby imparting to the golfer the same feel for swinging each of the golf clubs in the set but imparting a different trajectory to the golf balls struck thereby because of the difference in loft from one golf club in the set to another.

2. A method for a player to use substantially the same swing in striking a golf ball with any one of a set of a plurality of matched and correlated golf clubs wherein each golf club in the set has a shaft and a club head bearing a clubface at one end of the shaft, with each golf club in the set having essentially the same length, essentially the same weight, essentially the same swing weight and essentially the same lie, but differing from each other club of the set in loft, the method comprising the player following the steps of:

a. addressing a golf ball with one of the golf clubs in a typical manner;

b. pointing the player's arms at the ball at the time of address so that the center of the clubface is aligned upon the center of the golf ball to be struck, with the player's stance being such that the distance of the player's feet from the ball is essentially the same for each of the golf clubs;

c. maintaining that stance while swinging the golf club to strike the golf ball; and d. swinging the golf club to strike the golf ball so that the player's arms are outstretched and pointing at the ball with the club shaft pointing directly at the ball at the point of impact of the club head and golf ball, with the swing being substantially the same for each of the golf clubs.

* * * * *

UNITED STATES PATENT AND TRADEMARK OFFICE

CERTIFICATE OF CORRECTION

PATENT NO. : 4,784,390

DATED : November 15, 1988

INVENTOR(S) : Floyd D. Horgen

It is certified that error appears in the above-identified patent and that said Letters Patent is hereby corrected as shown below:

On the front page of the patent, in the title of the invention, change "GOLD" to read --GOLF--.

Signed and Sealed this

Eleventh Day of April, 1989

*Attest:*

DONALD J. QUIGG

*Attesting Officer*

*Commissioner of Patents and Trademarks*